US005323817A

United States Patent [19]

Spalding

[11] Patent Number: 5,323,817

[45] Date of Patent: Jun. 28, 1994

[54] GASOLINE DISPENSER WITH VAPOR RECOVERY SYSTEM

[75] Inventor: Robert G. Spalding, Salisbury, Md.

[73] Assignee: Dresser Industries, Inc., Dallas, Tex.

[21] Appl. No.: 966,266

[22] Filed: Oct. 26, 1992

Related U.S. Application Data

[62] Division of Ser. No. 693,549, Apr. 30, 1991, Pat. No. 5,195,564.

[51] Int. Cl.[5] ..... B65D 1/04

[52] U.S. Cl. ..... 141/1; 141/45; 141/59

[58] Field of Search ..... 141/1, 45, 59

[56] References Cited

U.S. PATENT DOCUMENTS

| | | | |
|---|---|---|---|
| 3,826,291 | 7/1974 | Steffens | 141/59 |
| 3,881,894 | 5/1975 | Onufer | 55/88 |
| 3,913,633 | 10/1975 | Hiller | 141/45 |
| 4,047,548 | 9/1977 | Wagner | 141/59 |
| 4,056,131 | 11/1977 | Healy | 141/206 |
| 4,057,086 | 11/1977 | Healy | 141/206 |
| 4,058,147 | 11/1977 | Stary et al. | 141/45 |
| 4,068,687 | 1/1978 | Long | 141/59 |
| 4,095,626 | 6/1978 | Healy | 141/206 |
| 4,167,958 | 9/1979 | Voelz | 141/95 |
| 4,197,883 | 4/1980 | Mayer | 141/59 |
| 4,202,385 | 5/1980 | Voelz et al. | 141/59 |
| 4,253,503 | 3/1981 | Gunn | 141/59 |
| 4,260,000 | 4/1981 | McGahay et al. | 141/59 |
| 4,295,505 | 10/1981 | Hasselmann et al. | 141/59 |
| 4,310,033 | 1/1982 | Deters | 141/44 |
| 4,336,830 | 6/1982 | Healy | 141/59 |
| 4,429,725 | 2/1984 | Walker et al. | 141/59 |
| 4,687,033 | 8/1987 | Furrow et al. | 141/59 |
| 5,038,838 | 8/1991 | Bergamini et al. | 141/59 |
| 5,040,577 | 8/1991 | Pope | 141/45 |

*Primary Examiner*—Henry J. Recla
*Assistant Examiner*—David J. Walczak
*Attorney, Agent, or Firm*—L. Dan Tucker

[57] ABSTRACT

A service station dispenser for gasoline with a vapor collection system for processing the electrical signal typically produced by the fuel meter which represents the volume flow rate of fuel to the tank to control the displacement volume of an electrically driven vacuum pump so that a simple vacuum intake disposed preferably inside, but not sealed with, the filter neck can be used to collect only the vapors displaced from the fuel tank by the fuel. The vacuum pump is preferably controlled by the same digital processor which calculates and displays volume and cost to the customer, and a single vacuum pump can be used in connection with single point of sale, multiple fuel grade systems or with multiple point of sale, single grade systems for enhanced economy of cost.

3 Claims, 4 Drawing Sheets

GASOLINE DISPENSER WITH VAPOR RECOVERY SYSTEM

This application is a division of application Ser. No. 07/693,549, filed Apr. 30, 1991, now U.S. Pat. No. 5,195,564.

FIELD OF THE INVENTION

This invention relates generally to volatile liquid dispensing systems of the type used to dispense gasoline into automotive fuel tanks, and more particularly relates to such a dispensing system which includes a vapor collecting system.

BACKGROUND OF THE INVENTION

As an automobile is being refueled with gasoline at a service station, each gallon of gasoline flowing into the fuel tank displaces approximately three hundred cubic inches of gasoline vapor which, unless collected, escapes into the atmosphere. Such vapors not only contribute to atmospheric pollution, but also are unpleasant to the person operating the nozzle, and may adversely affect the person's health over a longer term. As a result, some governmental authorities require that these vapors be collected. Various systems have been proposed and used for collecting and returning these vapors to a storage vessel, typically the underground storage tank from which the gasoline is being dispensed. The vapors thus stored are then collected for subsequent disposal by the over-the-road tanker when it delivers additional fuel to the storage tank.

In one such system, the dispensing pump nozzle is sealed to the filler pipe of the fuel tank so that the displaced vapor is directed by way of an annular conduit around the nozzle and coaxial dual conduit hose and appropriate plumbing to the underground storage tank. The design of the nozzle necessary to effect a seal has generally involved the addition of a bellows around the spout to seal the annular vapor passageway to the filler neck of the tank, as well as various other modifications which make the hand-held nozzle heavy and cumbersome, thereby causing the fueling process to be quite difficult and onerous, particularly for the self-serve motorist.

The problems relating to the design of the nozzle has been mitigated to a large extent by a system which utilizes a vacuum pump to assist the collection of vapor and transfer it to the storage tank. As a result of the use of the vacuum pump, it is unnecessary to seal the vapor line to the filler neck of the tank by the bellows, hence reducing the weight of the nozzle and simplifying the fueling process. In this type system, the vacuum inlet for the vapors need only be placed in close proximity to the filler neck of the tank. However, it is very important in this system that the rate of gaseous mixtures drawn in through the vacuum inlet closely approximate the volume of vapor being displaced by the gasoline flowing into the tank. If the volume of vapor being collected is less than that flowed from the tank, it will obviously result in some vapor escaping into the atmosphere. On the other hand, if a volume greater than the displaced vapors is collected, either air may be drawn in with the vapors, which can create a hazardous vapor/air mixture in the storage tank, or a portion of the gasoline dispensed into the tank will be vaporized to make up the difference between the volumetric displacement of the vacuum pump and the vapor displaced by the gasoline added to the fuel tank.

The systems previously developed which utilized this system achieved the control of the appropriate ratio of vapor to liquid dispensed by driving a positive displacement vacuum pump with a hydraulic motor driven by the flow of gasoline being dispensed to the tank. A major disadvantage of this type system (hereafter discussed in detail in connection with FIG. 2) is the requirement that there be a hydraulically-driven vacuum pump for each dispensing hose or nozzle; and each pump unit is relatively expensive to manufacture. In addition, the large number of individual nozzles associated with each typical multi-grade dispensing unit results not only in complex and expensive plumbing, but also occupies substantial space. Thus, the total cost of the system is a deterrent to its widespread adoption.

In another type system, a jet pump is driven by one of the submersible pumping units, for example, the regular grade, of the service station to generate a vacuum in a common vapor manifold. While this system does not eliminate the seal required at the nozzle, it does allow use of a less critical seal. The disadvantages of this type system are that whenever a dispenser for a premium grade is turned on, the regular grade submersible pump must be switched on regardless of whether the regular grade is selected or not by the customer. In addition to wasting power, this also tends to generate vapor at the regular grade pump unit. Further, the plumbing required is complex and subject to leaks, and a seal is still required at the nozzle sufficient to prevent air from being drawn into the system because the displacement of the jet pump is not related to the flow of gasoline at the dispensing point.

SUMMARY OF THE INVENTION

The present invention overcomes the disadvantages of the above systems in that it provides a system which eliminates the necessity of a seal between the vapor collection line and the filler neck of the fuel tank, yet provides an economical system for collecting only the correct volume of vapors for the amount of liquid being dispensed, and has progressively increasing economic advantage as the system becomes more complex, as is typical for multi-grade, multi-lane dispensing systems employed in modern self-service refueling facilities.

In accordance with the present invention, a volatile liquid such as gasoline is pumped from a storage tank through a flow meter and dispensed through an on-demand nozzle by the customer into the fuel tank of a vehicle. Vapors displaced from the tank are collected through a vacuum intake, preferably disposed concentrically with the nozzle and terminating near the end of the filler neck of the tank; and pumped by an electric motor driven vacuum pump to a vapor storage tank, preferably the fuel storage tank. The flow meter produces an electrical signal representative of the liquid volume flow rate which is used to control the volume of vapor pumped by the vacuum pump so that it is maintained at a preselected ratio with respect to the volume of liquid flowing into the fuel tank.

In accordance with another aspect of the invention, a single vacuum pump is manifolded to collect vapors from a plurality of dispensing nozzles. The nozzles can be part of a multi-grade, single point of sale system, or a combination of each by sizing the vacuum pump and controlling its volumetric rate dependent upon the total volume of liquid fuel being simultaneously dispensed from the nozzles.

DESCRIPTION OF THE DRAWINGS

These and other objects, features and advantages of the invention will be apparent to those skilled in the art from the following description of the preferred embodiment taken together with the accompanied drawings in which.

DESCRIPTION OF THE PRIOR ART

Figure 1:
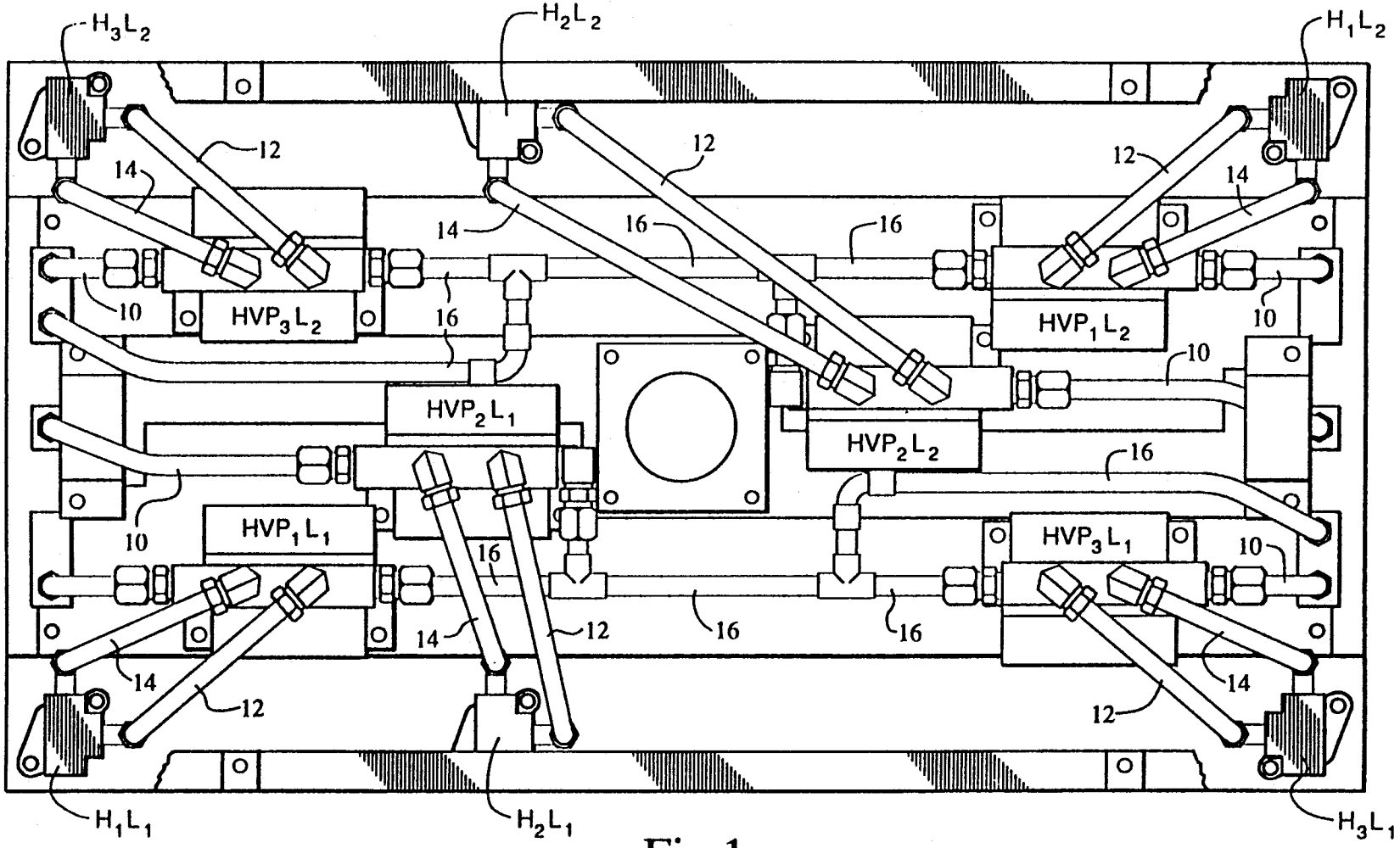
Fig. 1 (PRIOR ART)
FIG. 1 is a plan view of the typical plumbing layout of a prior art liquid dispensing system.

A prior art system is disclosed in FIG. 1 which includes a liquid dispensing system of the type referred to above which utilizes hydraulically-driven vacuum pumps to collect vapor and described generally in U.S. Pat. No. 4,202,385. FIG. 1 illustrates the plumbing arrangement for such a system which is designed to dispense three grades of fuel from two points of sale, one in each of two traffic lanes. Thus, the three grades of gasoline would be dispensed through hoses and associated nozzles attached to hose headers $H_1L_1$, $H_2L_1$ and $H_3L_1$ to serve a customer's vehicle in lane one. Similarly, three hoses would be attached to hose headers $H_1L_2$, $H_2L_2$ and $H_3L_2$ to dispense three grades of fuel to a vehicle in lane two. Each hose (not illustrated in FIG. 1) includes a fuel delivery line and a vapor return line communicating with a hand-held nozzle which includes only a hand-operated fuel valve. Hydraulically-driven vapor pumps $HVP_1L_1$, $HVP_2L_1$ and $HVP_3L_1$ are provided for the respective hose headers $H_1L_1$, $H_2L_1$ and $H_3L_1$ of lane one. Fuel lines 12 extend from the respective vapor pumps to the respective hose headers and vapor return lines 14 interconnect the respective headers and vapor pumps. After passing through a flow meter, fuel under pressure is delivered to the respective hydraulic motors of the vapor pumps by lines 10, and the vapor is output from the vacuum pumps to a common vapor header 16, which returns vapor to the separate fuel storage tanks (not illustrated) for the three grades of fuel. The tanks are interconnected by a common vapor header in the conventional manner. Thus, it will be seen that for a dual lane, dual point of sale dispenser for three grades of fuel, a total of six hydraulically-driven vapor pumps HVP are required together with all of the associated plumbing illustrated. Each HVP pump collects a volume of gas (vapor) which is 1.3 times as great as the equivalent volume of liquid gasoline passing through the hydraulic motor complex to drive the vacuum pump.

DESCRIPTION OF A PREFERRED EMBODIMENT OF THE INVENTION

Figure 2:
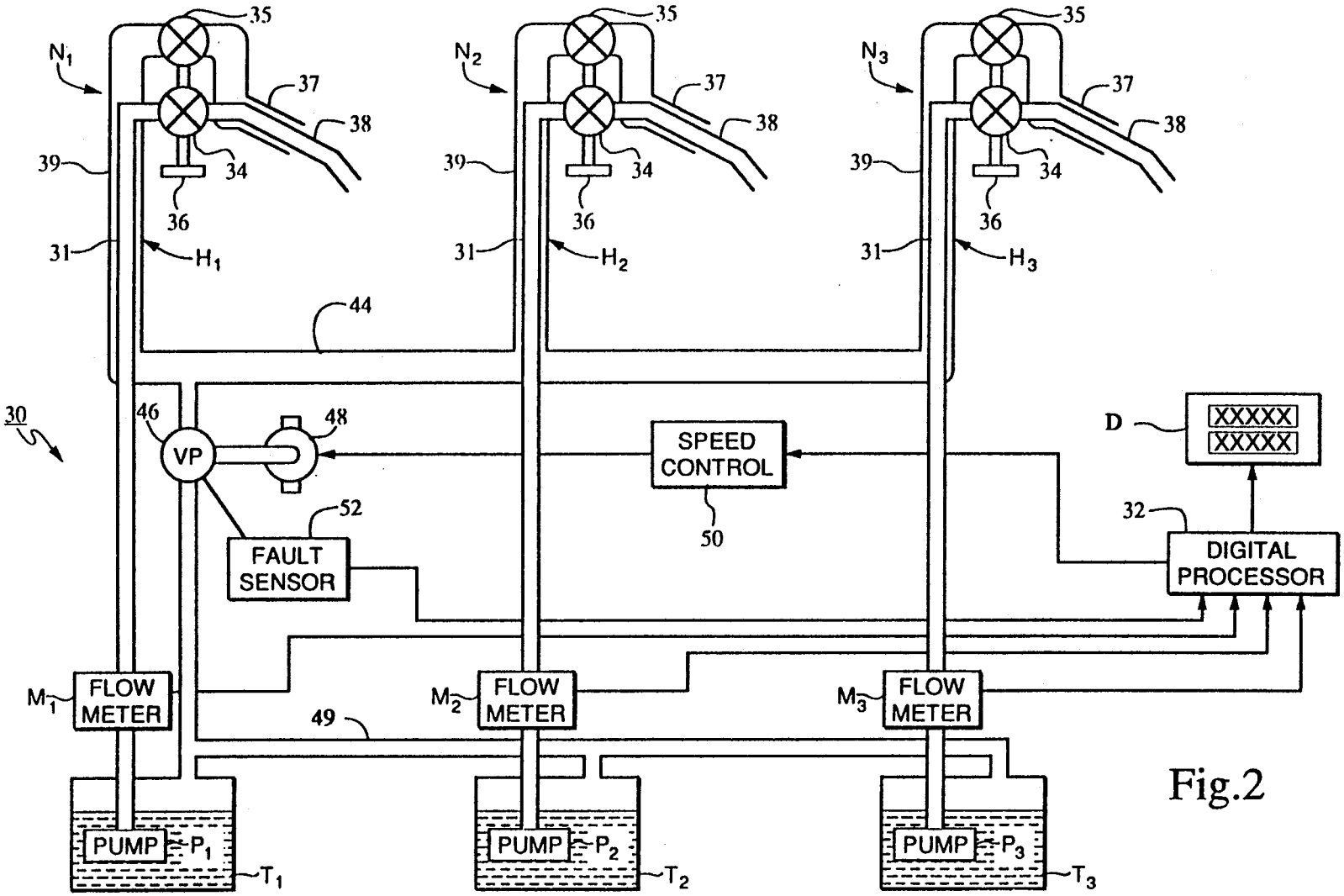
FIG. 2 is a schematic diagram which serves to illustrate a preferred embodiment of a liquid dispensing system in accordance with the present invention.

A liquid fuel dispensing system in accordance with the present invention is indicated generally by the reference numeral 30 in FIG. 2. The system 30 illustrates a single-point dispensing system for three different grades of fuel stored in tanks $T_1$, $T_2$ and $T_3$. A submersed pump $P_1$ delivers fuel from the tank $T_1$ through a flow meter $M_1$ and one conduit 31 of a dual-line flexible hose $H_1$ to a hand-held nozzle unit $N_1$. Similarly, fuel is delivered from tank $T_2$ by pump $P_2$ through flow meter $M_2$ and the fuel line 31 of dual conduit hose $H_2$ to nozzle $N_2$, and fuel is delivered from tank $T_3$ by pump $P_3$, through flow meter $M_3$, dual conduit hose $H_3$ and hand-held nozzle $N_3$.

Each of the flow meters, $M_1$, $M_2$ and $M_3$, produce an electrical signal indicative of the volume of liquid flowing through the meter to the respective nozzles, which signal is fed to a digital processor 32. The digital processor continually integrates the flow rate information to calculate the total volume and cost of the fuel as it is being dispensed through the meter activated by the customers use of the respective on-demand nozzle. This information is typically shown to the customer on a display D at the point of sale, and may also be displayed to the cashier in a self-service operation.

Each of the nozzles, $N_1$, $N_2$ and $N_3$, includes a fuel valve 34 and a vacuum valve 35 which are simultaneously operated by a hand actuated lever 36. A vacuum intake 37 is disposed adjacent a fuel outlet nozzle 38 so as to be partially within the filler neck of the tank, or in such other manner as to effectively capture the vapors displaced from the fuel tank as the gasoline flows into the tank. When the valves 34 and 35 are opened at the same time by the customer-actuated lever 36, the vacuum intake is opened to the vacuum return line 39 of the respective hose, $H_1$, $H_2$ or $H_3$, and thence to a common vacuum header 44, which in turn is connected to the intake of a positive displacement vacuum pump 46, which is preferably a conventional type pump. The output of the vacuum pump is connected to a vacuum header 48 interconnecting the fuel storage tanks $T_1$, $T_2$ and $T_3$.

The vacuum pump 46 is driven by a variable speed electric motor 49. electrical power for the motor and other electrical components are not illustrated for simplicity. The speed of the motor 49 is controlled by a suitable speed control circuit 50 which, in turn, is controlled by an output from the digital processor 32. A fault sensor 52 detects a failure of operation of the vacuum pump and provides an appropriate signal to the digital processor 32 which disables the system from dispensing fuel in the event of a vacuum pump failure. The digital processor 32 can be a dedicated microprocessor, but in a preferred embodiment of the invention, is the processor which also operates the total service station system and includes the calculation of the volume being delivered to the customer and the cost, which information is displayed at the point of sale by display 33.

A typical delivery rate of fuel through a selected nozzle is about ten gallons per minute, thus requiring about three thousand cubic inches per minute displacement for the vacuum pump at a maximum speed of about 1,500 rpm. Such a pump typically requires a two-amp, 120 volt, 50/60 cycle electric motor with a speed range from zero to 1,500 rpm. Such a pump and motor can be manufactured at a relatively low cost. The speed control 50 is of conventional design, and is responsive to an appropriate signal produced by the digital processor 32 in response to the signal from the active flow meter $M_1$, $M_2$ or $M_3$, which typically provides pulses at a rate corresponding to the flow rate through the meter. The rate of these pulses can easily be translated into the appropriate signal to synchronize the pumping rate of the vacuum pump with the flow rate of the gasoline through the meter and maintain a predetermined vapor/gasoline ratio, preferably 1.3:1.0.

In the operation of the system 30 of FIG. 2, the pumps $P_1$, $P_2$ and $P_3$ provide liquid fuel under pressure to the respective nozzles $N_1$, $N_2$ and $N_3$. When a customer selects a grade of fuel and inserts the selected nozzle 38 in the neck of the tank, the vacuum intake 37 is disposed slightly within the filler neck of the tank. When the customer activates the nozzle lever, both the fuel valve 34 and vacuum valve 35 are opened and fuel flows into the customer's tank. Fuel flowing through the respective meter causes a signal to be sent to the digital processor 32 which causes the speed control to operate the electric motor at the appropriate rate to collect only the vapors displaced from the fuel tank. The vapors are returned to the fuel storage tanks to replace the liquid fuel being withdrawn.

Figure 3:
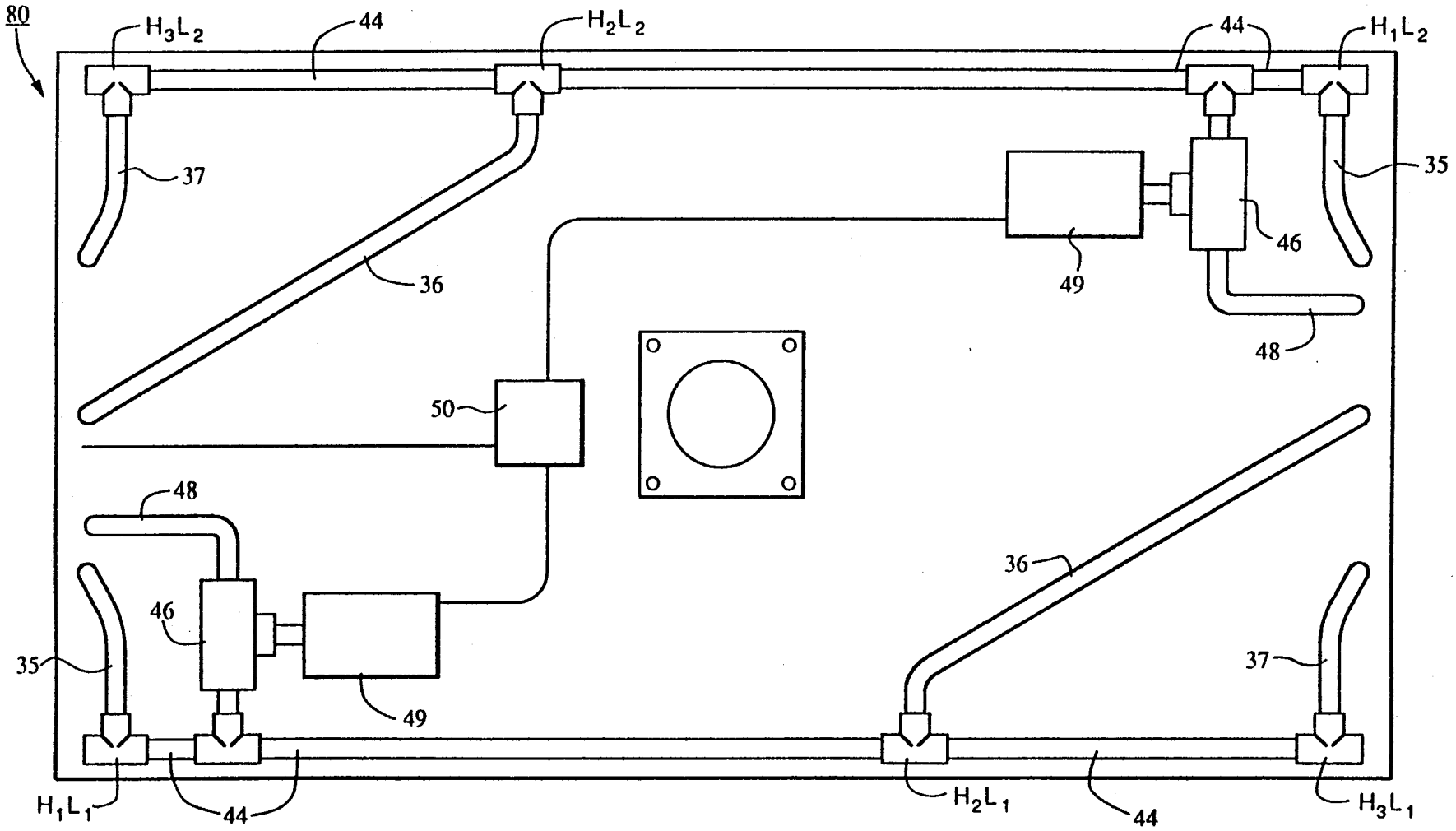
FIG. 3 is a plan view of a plumbing diagram illustrating the liquid dispensing system of FIG. 2 as compared to the prior art system of FIG. 1; and, FIG. 4 is a schematic diagram of an alternative liquid dispensing system in accordance with the present invention.

The advantages of the system of FIG. 2 compared to the prior art device of FIG. 1 are readily apparent from FIG. 3. FIG. 3 depicts the system of FIG. 2 designed to provide a two-lane unit, indicated generally by the reference numeral 80, capable of dispensing three grades from a single point of sale for each lane, which is the same type unit as disclosed as prior art in FIG. 1. Accordingly, the same reference characters are used for the corresponding components $H_1L_1$, $H_2L_1$ and $H_3L_1$ and $H_1L_2$, $H_2L_2$ and $H_3L_2$. The hose manifolds $H_1L_1$, $H_2L_1$ and $H_3L_1$ are the swivel connections for the dual conduit hoses $H_1$, $H_2$ and $H_3$ for the system 30 of FIG. 2. The vapor manifold 44 collects the vapors from the three hoses and directs it to the intake of vacuum pump 46, the output of which is fed to the storage tank manifold 48. Fuel lines 40, 41, and 42 extend to the respective hoses $H_1$, $H_2$ and $H_3$ for lane one. The speed controller 50 controls the motor 49 which drives the vacuum pump. A duplicate set of parts to that just described is associated with hoses $H_1L_2$, $H_2L_2$ and $H_3L_2$ for service lane two and are designated by corresponding reference characters. From a comparison of FIGS. 1 and 3, it will be appreciated that the system of the present invention shown in FIG. 3 is substantially less complex and less expensive to fabricate than the prior art system shown in FIG. 1. The more complex the system, the greater the cost savings of the present invention.

Figure 4:
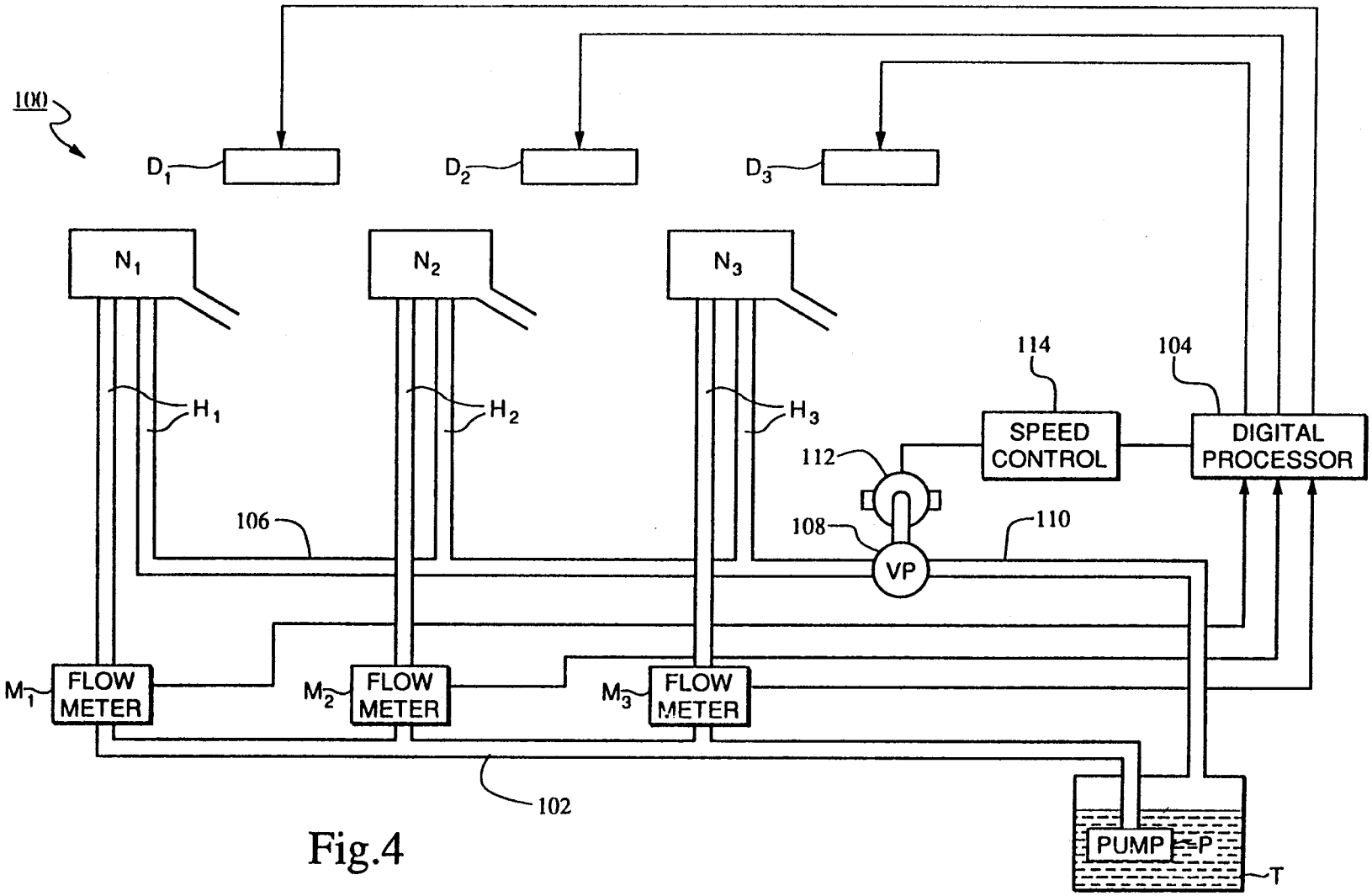

Another embodiment of the present invention is indicated generally by the reference numeral 100 in FIG. 4. This system is similar to the single point of sale, multiple grade system 30 of FIG. 2, but is designed to provide a plurality of points of sale of a single grade of fuel. Where applicable, the same reference characters are used to designate the same component parts. The system 100 includes a single fuel tank T having a submersed pump P which pressurizes a fuel manifold 102. The manifold 102 provides fuel to three flow meters $M_1$, $M_2$ and $M_3$ which measure the flow rate of fuel being fed through concentric, dual conduit, flexible hoses $H_1$, $H_2$ and $H_3$ to nozzles $N_1$, $N_2$ and $N_3$, each having both a fuel valve and vacuum valve, all of which may be substantially as heretofore described in connection with the system 30 of FIG. 2. However, the electrical signals representing volume flow rate information from the meters $M_1$, $M_2$ and $M_3$ are each fed to a digital processor 104 which, in turn, provides point of sale volume and cost information to displays $D_1$, $D_2$ and $D_3$ associated with the fuel dispensed through the respective nozzles $N_1$, $N_2$ and $N_3$. A vapor collection manifold 106 is connected to the intake of a vapor vacuum pump 108, the output of which is connected back to the storage tank T by conduit 110. The vapor pump is driven by an electric motor 112, the speed of which is controlled by speed controller 114.

The vapor collection system 100 is thus very similar to that illustrated in FIG. 2 except that the vapor pump 108 must have a capacity adequate to handle the total vapor collections from all of the nozzles $N_1$, $N_2$ and $N_3$ when fuel is being dispensed from all of the nozzles simultaneously. As a consequence, the digital processor 104 provides an output to the speed controller 114 which is the sum of the total flow rates through meters $M_1$, $M_2$ and $M_3$. Also, the manifold 106 is designed such that the resistance to vapor flow through the respective hoses $H_1$, $H_2$ and $H_3$ and manifold are essentially equal. Further, the manually-operated vapor control valves, and the respective fuel valves are metering valves so that vapor is metered in by partially open vapor valves in the same proportion as fuel is metered out by a partially open fuel valve. Thus, the vacuum pump 108 is operated at a capacity sufficient to provide a total vapor displacement volume appropriate for the total liquid volume being dispensed through all the nozzles. Operating the proportioning valves in the vapor lines in synchronism with the respective fuel valves result in the appropriate amount of vapor being withdrawn from each of the respective fuel tanks being filled. It will, of course, be appreciated that the system of FIG. 4 is applicable for one, or any number of dispensing nozzles.

It will be appreciated that the vacuum pump means 46 and 49 can alternatively be a constant speed electric motor with a variable volume vacuum pump responding to the electrical signal from the digital processor. It will also be appreciated that a dedicated digital processor, or other electrical system can be used to control the volume throughput of the vacuum pump in response to the measured liquid flow rate.

Although preferred embodiments of the invention have been described in detail, it is to be understood that various changes, substitutions and alterations can be made therein without departing from the spirit and scope of the invention as defined by the appended claims.

What is claimed is:

1. The method of dispensing a single grade of liquid fuel from a single storage tank through a plurality of hand-held nozzles, each disposed at a separate point of sale and having normally closed fuel and vacuum valves, into a customer's fuel tank having a filler neck which comprises:

on demand from one or more customer's simultaneous operation of the fuel and vacuum valves associated with at least one of the respective nozzles, pumping the fuel from the storage tank through a separate meter for each of the nozzles being operated and producing an electrical signal representative of the volume of fuel passing through the respective meter and nozzle;

digitally processing the electrical signals from all of the meters; and operating an electrically driven vacuum pump connected to allow the vacuum valves, which are positioned closely adjacent to, but not sealed with, the fuel tank, when open to collect vapors displaced from all of the fuel tanks to which fuel is being dispensed, by a vacuum intake disposed adjacent to, but not sealed with, the filler neck of the customers' fuel tank at a vapor volume flow rate related in a predetermined manner to the total flow rate of fuel to all of the fuel tanks.

2. The method of claim 1 wherein the vapors collected at each fuel tank is maintained proportional to the liquid fuel dispensed into the respective fuel tank by maintaining the degree of the opening of the vacuum valve in predetermined relationship to the degree of opening of the fuel valve.

3. The method of claim 1 wherein the electrical signal from each meter is digitally processed to calculate total fuel volume dispensed through the respective nozzle and the cost thereof, and the information for each is displayed for the customer at the respective point of sale.

* * * * *